US011600433B2

(12) United States Patent
Jiang et al.

(10) Patent No.: US 11,600,433 B2
(45) Date of Patent: Mar. 7, 2023

(54) STRANDED WIRE CONTACT FOR AN ELECTRICAL DEVICE AND METHOD FOR PRODUCING A STRANDED WIRE CONTACT

(71) Applicant: TDK Electronics AG, Munich (DE)

(72) Inventors: Yun Jiang, Neubiberg (DE); Karl Stoll, Germering (DE)

(73) Assignee: TDK Electronics AG, Munich (DE)

( * ) Notice: Subject to any disclaimer, the term of this patent is extended or adjusted under 35 U.S.C. 154(b) by 373 days.

(21) Appl. No.: 16/649,312

(22) PCT Filed: Sep. 18, 2018

(86) PCT No.: PCT/EP2018/075214
§ 371 (c)(1),
(2) Date: Mar. 20, 2020

(87) PCT Pub. No.: WO2019/057713
PCT Pub. Date: Mar. 28, 2019

(65) Prior Publication Data

US 2020/0265992 A1 Aug. 20, 2020

(30) Foreign Application Priority Data

Sep. 21, 2017 (DE) ..... 102017121908.0

(51) Int. Cl.

| | |
|---|---|
| ***H01R 43/02*** | (2006.01) |
| ***H01F 27/29*** | (2006.01) |
| ***H01F 27/28*** | (2006.01) |
| ***H01F 41/10*** | (2006.01) |
| ***H01R 4/18*** | (2006.01) |

(52) U.S. Cl.
CPC ..... *H01F 27/292* (2013.01); *H01F 27/2828* (2013.01); *H01F 41/10* (2013.01); *H01R 4/183* (2013.01)

(58) Field of Classification Search
CPC ..... H01R 43/0249
See application file for complete search history.

(56) References Cited

U.S. PATENT DOCUMENTS

| | | | |
|---|---|---|---|
| 2,877,441 | A | 3/1959 | Narozny |
| 3,609,616 | A | 9/1971 | Dumeige |
| 3,808,588 | A | 4/1974 | McGregor |

(Continued)

FOREIGN PATENT DOCUMENTS

| | | | |
|---|---|---|---|
| CA | 2098006 | A1 | 7/1992 |
| CN | 101490903 | A | 7/2009 |

(Continued)

OTHER PUBLICATIONS

International Search Report and Written Opinion in European Patent Application No. PCT/EP2018/075485 dated Mar. 28, 2019 (9 pages).

(Continued)

*Primary Examiner* — Sherman Ng
(74) *Attorney, Agent, or Firm* — Nixon Peabody LLP

(57) ABSTRACT

An electrical device having a stranded wire contact. The device includes a stranded wire with individual wires and a contact piece for electrical contacting of the stranded wire. The stranded wire contact is produced by thermal diffusion bonding.

20 Claims, 9 Drawing Sheets

(56) References Cited

U.S. PATENT DOCUMENTS

Figure 1A:
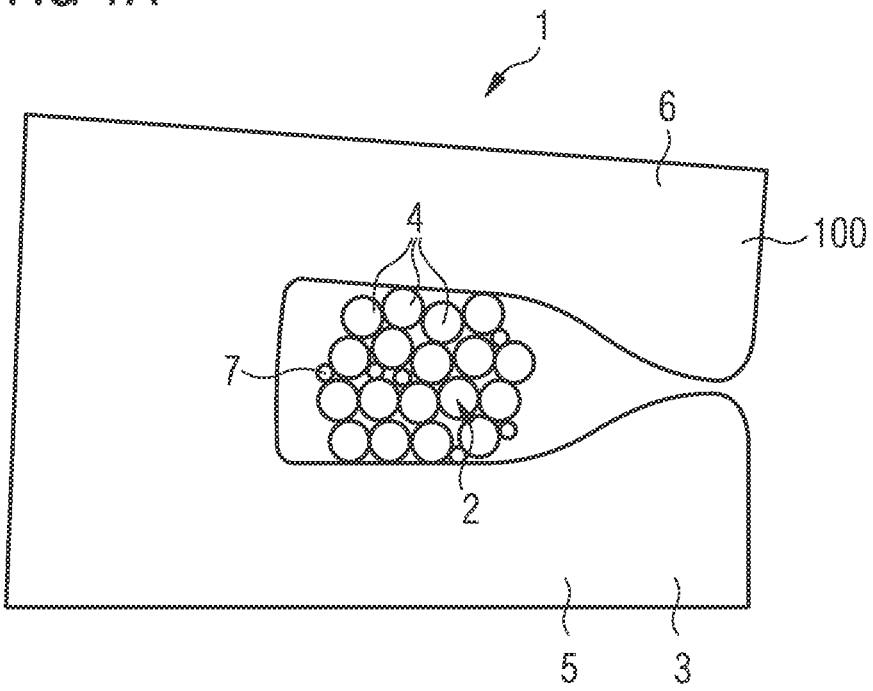

| | | | | |
|---|---|---|---|---|
| 3,963,857 | A * | 6/1976 | Reynolds | H01R 4/2495 439/421 |
| 3,995,931 | A | 12/1976 | Pienkowski | |
| 4,549,042 | A | 10/1985 | Akiba et al. | |
| 5,012,125 | A | 4/1991 | Conway | |
| 5,316,506 | A | 5/1994 | Ito | |
| 5,414,926 | A | 5/1995 | Ito et al. | |
| 5,612,508 | A | 3/1997 | Kasper | |
| 5,772,454 | A | 6/1998 | Long, Jr. | |
| 6,125,533 | A | 10/2000 | Warner | |
| 7,462,081 | B2 | 12/2008 | Kato | |
| 8,635,770 | B2 | 1/2014 | Warner | |
| 9,318,814 | B2 | 4/2016 | Tomita | |
| 9,672,972 | B2 | 6/2017 | Takiguchi | |
| 2002/0175798 | A1 | 11/2002 | Sigi | |
| 2005/0046534 | A1 | 3/2005 | Gilmartin et al. | |
| 2005/0233638 | A1* | 10/2005 | Taylor | H01R 4/183 439/585 |
| 2007/0080592 | A1 | 4/2007 | Ohta | |
| 2009/0218134 | A1 | 9/2009 | Stroh et al. | |
| 2009/0315419 | A1 | 12/2009 | Mita et al. | |
| 2010/0096185 | A1 | 4/2010 | Otsuka | |
| 2013/0005197 | A1 | 1/2013 | Sato | |
| 2013/0199841 | A1 | 8/2013 | Lehmann | |
| 2013/0213710 | A1 | 8/2013 | Ohnuma et al. | |
| 2015/0061811 | A1 | 3/2015 | Takagi et al. | |
| 2015/0360319 | A1 | 12/2015 | Yagi et al. | |
| 2016/0006134 | A1 | 1/2016 | Ohnuma | |
| 2016/0028167 | A1 | 1/2016 | Hanazaki | |
| 2016/0099510 | A1 | 4/2016 | Trafton | |
| 2016/0276998 | A1 | 9/2016 | Hsieh et al. | |
| 2016/0336662 | A1 | 11/2016 | Ooba | |
| 2017/0069975 | A1* | 3/2017 | Baldauf | H01R 43/0207 |
| 2017/0179663 | A1* | 6/2017 | Miyakawa | H01R 4/185 |
| 2017/0214156 | A1 | 7/2017 | Washio et al. | |
| 2018/0053582 | A1 | 2/2018 | Koeppendoerfer et al. | |
| 2019/0341164 | A1 | 11/2019 | Sakamoto et al. | |

FOREIGN PATENT DOCUMENTS

| | | | |
|---|---|---|---|
| CN | 101607343 | A | 12/2009 |
| CN | 102823064 | A | 12/2012 |
| CN | 103038944 | A | 4/2013 |
| CN | 103155284 | A | 6/2013 |
| CN | 104425105 | A | 3/2015 |
| CN | 105026098 | A | 11/2015 |
| CN | 105122549 | A | 12/2015 |
| CN | 105191020 | A | 12/2015 |
| CN | 105261911 | A | 1/2016 |
| CN | 106033928 | A | 10/2016 |
| CN | 106063039 | A | 10/2016 |
| DE | 102011118293 | A1 | 5/2013 |
| DE | 102012103162 | A1 | 10/2013 |
| DE | 102013225565 | A1 | 6/2015 |
| JP | S58-005286 | A | 1/1983 |
| JP | S5823106 | A | 2/1983 |
| JP | S63-080827 | U | 5/1988 |
| JP | S63146969 | U | 9/1988 |
| JP | H03 289105 | A | 3/1990 |
| JP | H10-125363 | A | 5/1998 |
| JP | 2002-198155 | A | 7/2002 |
| JP | 2003-145274 | A | 5/2003 |
| JP | 2003134218 | A | 5/2003 |
| JP | 2003234218 | A | 8/2003 |
| JP | 2004214371 | A | 7/2004 |
| JP | 2007-128657 | A | 5/2007 |
| JP | 2007-273757 | A | 10/2007 |
| JP | 3140817 | U | 4/2008 |
| JP | 2009-070769 | A | 4/2009 |
| JP | 3174350 | U | 3/2012 |
| JP | 2012084472 | A | 4/2012 |
| JP | 2012-134111 | A | 7/2012 |
| JP | 2013020761 | A | 1/2013 |
| JP | 2013187171 | A | 9/2013 |
| JP | 2016091799 | A | 5/2016 |
| JP | 6172468 | B1 | 8/2017 |
| WO | WO 2015/014647 | A | 2/2015 |

OTHER PUBLICATIONS

Chinese Patent Office, Notification for Going Through Patent Registration Formalities and Notification of Grant of Patent for Protection, with search report, in Application No. 201880060654.X, dated May 7, 2022, with English translation (8 pages).

* cited by examiner

STRANDED WIRE CONTACT FOR AN ELECTRICAL DEVICE AND METHOD FOR PRODUCING A STRANDED WIRE CONTACT

CROSS-REFERENCE TO RELATED APPLICATIONS

This application is a U.S. National Stage of International Application No. PCT/EP2018/075214, filed Sep. 18, 2018, which claims the benefit of Germany Patent Application No. 102017121908.0, filed Sep. 21, 2017, both of which are incorporated herein by reference in their entireties.

The present invention relates to a stranded wire contact for an electrical device, i.e. a contact region of the device comprising a section of a stranded wire, in particular a stranded wire end. The device is in particular an inductive device. The stranded wire forms a functional element of the device, for example. The stranded wire for example forms a winding, in particular a coil of the device. In particular, the stranded wire is a high-frequency stranded wire.

The stranded wire contact serves for electrical connection of the stranded wire, for example to a connection piece of the device, in particular a contact pin. The stranded wire contact may also be configured for direct contacting to a printed circuit board.

When producing the stranded wire contact the insulation also has to be removed from the stranded wire. For example, each individual wire of the stranded wire has insulation in the form of enameling. In addition, the entire stranded wire may also be sheathed. The individual wires may be twisted together. Moreover, the individual wires may be wound around a connection piece. This makes it more difficult to reliably remove the insulation from the individual wires and the external insulation from the stranded wire.

A stranded wire contact is conventionally produced by soldering, wherein the temperature is selected to be sufficiently high for the insulation to be removed at the same time as the stranded wire contact is produced. Such soldering processes take place, for example, through immersion into a solder bath or by wave soldering with liquid tin or tin alloy. When using enamel insulation comprising polyurethane of the temperature class from 155° C. to 180° C., to remove the insulation reliably solder bath or solder wave temperatures of around 400° C. are often necessary.

In many cases the insulation is of a still higher temperature class. This is the case for example with insulation made of polyester imides or polyimides. In this case, two-stage production of the stranded wire contact is often necessary. In such a process, a first step involves removal, for example mechanical removal, of the insulation by burning off or using chemical methods. In a second step, a soldering process is then carried out, in order to produce a mechanical and electrical connection.

A disadvantage of such soldering methods is that the heated air comes into direct contact, via the soldering fluid, with a functional element of the device, for example a winding. In addition, creeping flow of the hot solder fluid along the stranded wire towards a functional element may arise. This leads to undesirable damage to the insulation and to an increased risk of failure. In addition, undesirable balls of solder may arise as a result of evaporation of the insulation. Furthermore, such methods are costly and time-consuming.

It is an object of the present invention to provide an improved stranded wire contact for an electrical device.

According to a first aspect of the present invention, an electrical device with a stranded wire contact is provided.

The stranded wire contact comprises a portion of a stranded wire. The stranded wire has a multiplicity of individual wires. The stranded wire for example forms a winding of the device, in particular a coil. The electrical device takes the form of an inductive device, for example. Each individual wire within the winding is, for example, surrounded by separate insulation. For example, it comprises enamel insulation. In addition, the stranded wire may be surrounded by external insulation, in particular sheathing. The stranded wire may however also be free of any additional external sheathing. In particular, the stranded wire is a high-frequency stranded wire.

The stranded wire contact is configured for electrical contacting of the stranded wire. In particular, the stranded wire contact comprises one end of the stranded wire which projects out of the winding. The stranded wire contact may be arranged at a short distance from a winding of the stranded wire, for example at a distance of a few mm.

The stranded wire contact additionally has a contact piece which surrounds the portion of the stranded wire at least in part. The contact piece is connected with the stranded wire in particular by thermal diffusion bonding.

The connection by thermal diffusion bonding is apparent from the finished device. In diffusion bonding the individual wires and the contact piece are connected together through exposure to pressure and elevated temperature. In this case, the temperature is lower than the melting temperature of the material of the contact piece and the material of the individual wires. In diffusion bonding, bilateral diffusion takes place at an atomic level over the boundary surfaces of the parts to be connected together, resulting in an intimate connection of the parts. In the stranded wire contact it is possible both for the contact piece to be connected to the individual wires by diffusion bonding, and the individual wires to one another.

The stranded wire contact may exhibit residues from the insulation, for example in the form of clumped particles. In diffusion bonding, for example, the insulation of the individual wires and/or the external insulation of the stranded wire is melted. This enables the stranded wire to be connected to the contact piece without separate removal of the insulation.

The stranded wire contact is in particular produced soldering-free, i.e. without soldering. The undesirable side effects which arise during soldering, such as for example damage to the adjacent winding due to the evolution of heat or troublesome balls of solder, are thus absent. The stranded wire contact is in particular free both of solder material used during soldering and of a further bonding material such as for example a conductive adhesive.

The contact piece is electrically conductive and in particular comprises a metal. The contact piece is in particular in electrical contact with the stranded wire. During production of the stranded wire contact, the contact piece may serve as a current carrier for removal of the insulation from the stranded wire.

The contact piece may additionally also ensure mechanical fixation of the stranded wire. The contact piece may for example fix the stranded wire on a connection piece of the component or take the form of a connection piece.

The connection piece is arranged, for example, on a support element of the component. The support element may be configured to support a winding of the stranded wire. The support element may alternatively or additionally be configured to support the connection piece or further elements. The support element may also be a housing part of the device. The support element is made from an electrically insulating material, for example.

The stranded wire and the connection piece may each have a free end. The free ends of the stranded wire and of the connection piece for example point in the same direction as the device. In particular, the free ends may terminate flush with one another.

The connection piece has a conductive, in particular metallic material. The connection piece for example takes the form of a contact pin. The connection piece may take the form of an individual contact finger. The connection piece may also have a plurality of regions between which the stranded wire is arranged. For example, the connection piece takes the form of a fork with two tines. The connection piece may also have another shape.

The device may have a plurality of connection pieces. For example, the device has a plurality of connection pieces arranged adjacent one another. The device may also have connection pieces on two opposing sides. The device may have a plurality of stranded wires, which are each connected with a connection piece.

In one embodiment, the device has a terminal piece for electrically connecting the device. The terminal piece may in particular be configured for connection to a printed circuit board. The terminal piece is for example configured for PTH (pin through hole) mounting. Alternatively, the terminal piece may also be configured for SMD mounting, i.e. for surface mounting. The terminal piece is configured, for example, as a terminal pin. The device may have a plurality of terminal pieces. For example, a terminal piece is provided for each connection piece. The terminal piece is electrically connected with the stranded wire contact. The terminal piece may be electrically connected with the contact piece and/or the connection piece.

The terminal piece and a connection piece connected thereto point in different directions, for example. For example, the connection piece is sideways oriented and the terminal piece downwards oriented. The connection piece protrudes laterally from the support element, for example, and the terminal piece protrudes downwards from the support element. The connection piece and the terminal piece may also parallel extend parallel to one another.

The terminal piece and the connection piece may be configured in one piece. For example, the terminal piece and the connection piece are different ends of an angle.

In one embodiment, the contact piece has two sub-regions, between which the stranded wire is arranged. The sub-regions take the form of two legs, for example. When producing the stranded wire contact, the stranded wire is inserted between the sub-regions, for example, and the sub-regions are then pressed against the stranded wire during diffusion bonding. In particular, the sub-regions are facing relative to the stranded wire. In particular, the sub-regions are pressed together from outside. The two sub-regions are thus then connected with individual wires by diffusion bonding.

In one embodiment, the contact piece takes the form of a connection piece. The connection piece in particular produces a connection to a terminal piece of the component. A configuration of the connection piece with two sub-regions into which the stranded wire is inserted enables a stable arrangement of the stranded wire on the contact piece prior to and during thermal diffusion bonding. In this case, it is not necessary to wind the stranded wire around the connection piece or otherwise to fasten it. Furthermore, as a result of diffusion bonding of the stranded wire with two sub-regions of the connection piece, a particularly reliable connection is ensured. In addition, no additional connection material, in particular no solder material, is needed for the stranded wire contact.

In one embodiment, the contact piece takes the form of an enclosure element, which surrounds the stranded wire at least in part. The enclosure element is in particular a "splice crimp". In this case, the enclosure element takes the form of a metallic band piece bent around the conductors.

In one embodiment, the enclosure element configured as a contact piece is present, in addition to a connection piece on which the stranded wire is arranged. In this case, the enclosure element may on the one hand assume the function of a current carrier during thermal diffusion bonding. On the other hand, the enclosure element may ensure reliable fixation of the contact piece on the connection piece. The enclosure element may be led fully around the stranded wire and the connection piece.

Here, in an embodiment in which the stranded wire contact is formed solely by a connection piece and the portion of the stranded wire, it is the connection piece which is denoted a contact piece. In an embodiment in which the stranded wire contact is formed from an enclosure element, a stranded wire and a connection piece, it is the enclosure element which is denoted a contact piece.

In an alternative embodiment, the stranded wire contact does not have a connection piece and is thus formed solely of the enclosure element and a portion of the stranded wire. The stranded wire contact thus serves for direct connection to a printed circuit board, without an additional terminal piece. The device may have a holding device for fixation of the stranded wire contact or be free of a holding device.

If the contact piece takes the form of an enclosure element, a metallic band piece is provided, for example in a flat shape, and bent around the conductors arranged against one another. The enclosure element is thus given its shape, in particular a sleeve shape, only on arrangement around the conductors.

After the shaping process, lateral regions of the band piece may overlap. Through the overlap of the lateral regions, such an enclosure element may differ from a prefabricated sleeve, such as for example a cable lug.

According to a further aspect of the present connection, an electrical device with a stranded wire contact is provided, wherein the stranded wire contact comprises a portion of a stranded wire with a multiplicity of individual wires and a connection piece. The connection piece is fastened to a support element of the device. The stranded wire contact is in particular formed without soldering, i.e. without a soldering operation.

The device may have all the functional and structural characteristics of the above-described device. In particular, the stranded wire contact may be produced by thermal diffusion bonding. The connection piece may produce an electrical connection between the stranded wire contact and a terminal piece of the device.

According to a further aspect of the present invention, a method is provided for producing a stranded wire contact of an electrical device. The stranded wire contact has a portion of a stranded wire and a contact piece. The stranded wire contact and the device may in particular be those described above.

In this case, a stranded wire having a multiplicity of individual wires is provided. The individual wires each for example exhibit insulation in the form of an enamel layer. In addition, the stranded wire may have external insulation, for example in the form of a sleeve.

An arrangement of the stranded wire with a contact piece of the electrical device is formed. In one embodiment, the contact piece comprises a connection piece, for example in the form of a rigid contact pin. The connection piece is for example arranged on a support element, in particular an insulating support element of the device.

In an alternative embodiment the contact piece is an enclosure element, for example in the form of a metallic band piece ("splice crimp"). The stranded wire may in this case be arranged on a connection piece and then an arrangement is formed of the stranded wire arranged on the connection piece with the enclosure element formed as a contact piece. As an alternative, the connection piece may be absent and an arrangement just of enclosure element and stranded wire is formed.

The stranded wire is connected to the contact piece by thermal diffusion bonding. Mechanical pressure is in this case exerted on the arrangement of stranded wire and contact piece. In particular, the stranded wire is pressed against the contact piece. At the same time, the arrangement is heated. The heating may also cause removal at least in part of the insulation.

Heating proceeds for example by current flow. In particular, heating arises due to the electrical resistance of the insulation.

Once the connection is produced, a free end of the stranded wire is detached. In this case, a free end of the contact piece may also be detached. In particular, the free ends may be detached in such a way that they terminate flush with one another.

In one embodiment, the contact piece has two sub-regions, in between which the stranded wire is inserted. The sub-regions may be pressed against the stranded wire during diffusion bonding.

The stranded wire contact may also be suitable for wires other than stranded wires. For example, an individual wire is an option. Thus, in the present case the device and the method are also disclosed with connection of a contact piece with a wire other than a stranded wire.

The present disclosure describes multiple aspects of an invention. All the characteristics which have been disclosed in relation to the stranded wire contact, the device or the method are accordingly also disclosed in relation to the other aspects, even if the respective characteristic is not mentioned explicitly in the context of the other aspects.

Furthermore, the description of the subjects indicated here is not restricted to the individual specific embodiments. Instead, the features of the individual embodiments may, insofar as technically meaningful, be combined with one another.

The subjects described here are explained in greater detail below with reference to schematic exemplary embodiments.

Figure 1B:
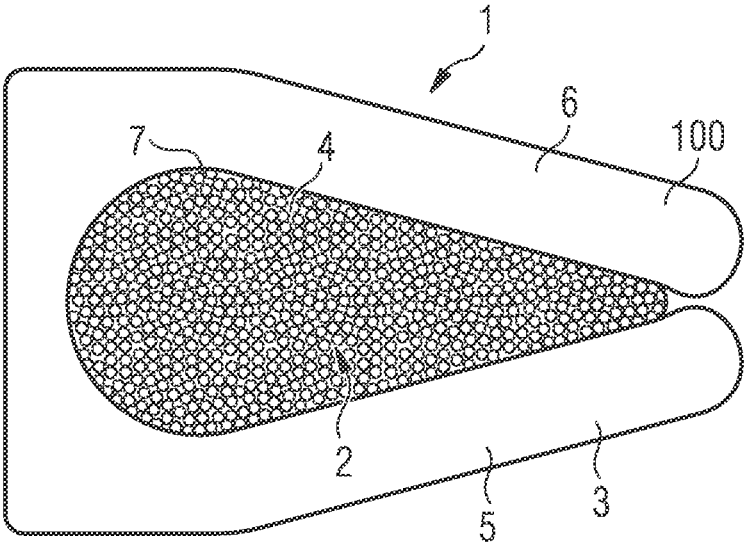
Figure 2:
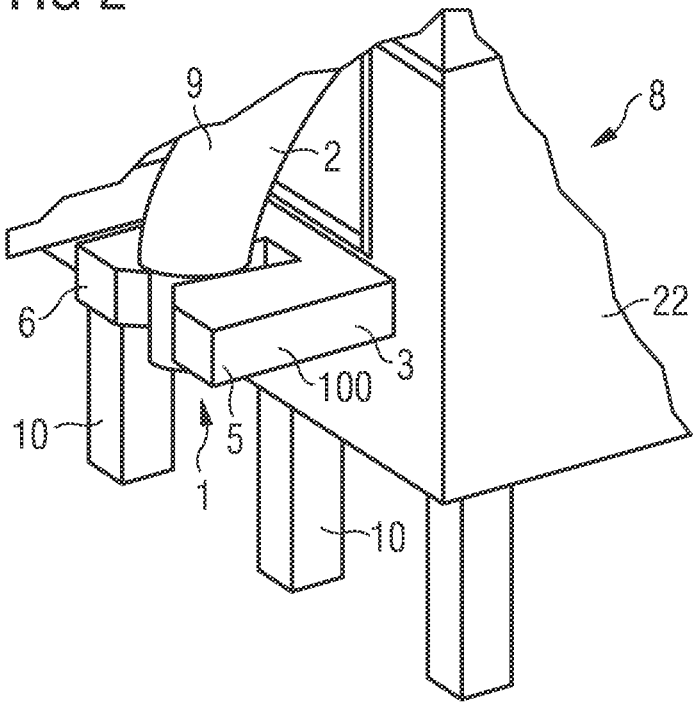
Figure 3A:
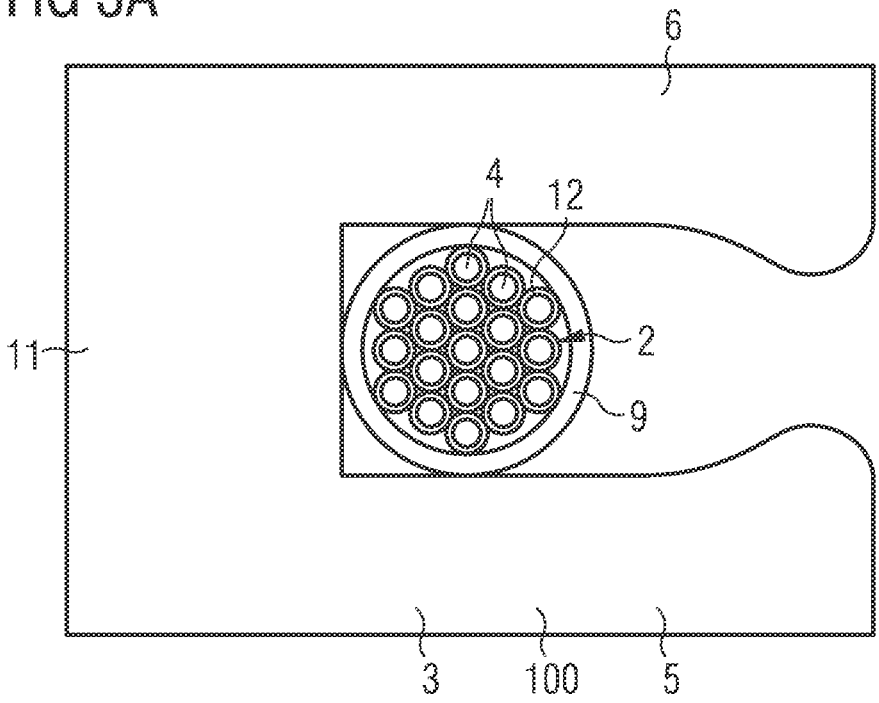
Figure 3B:
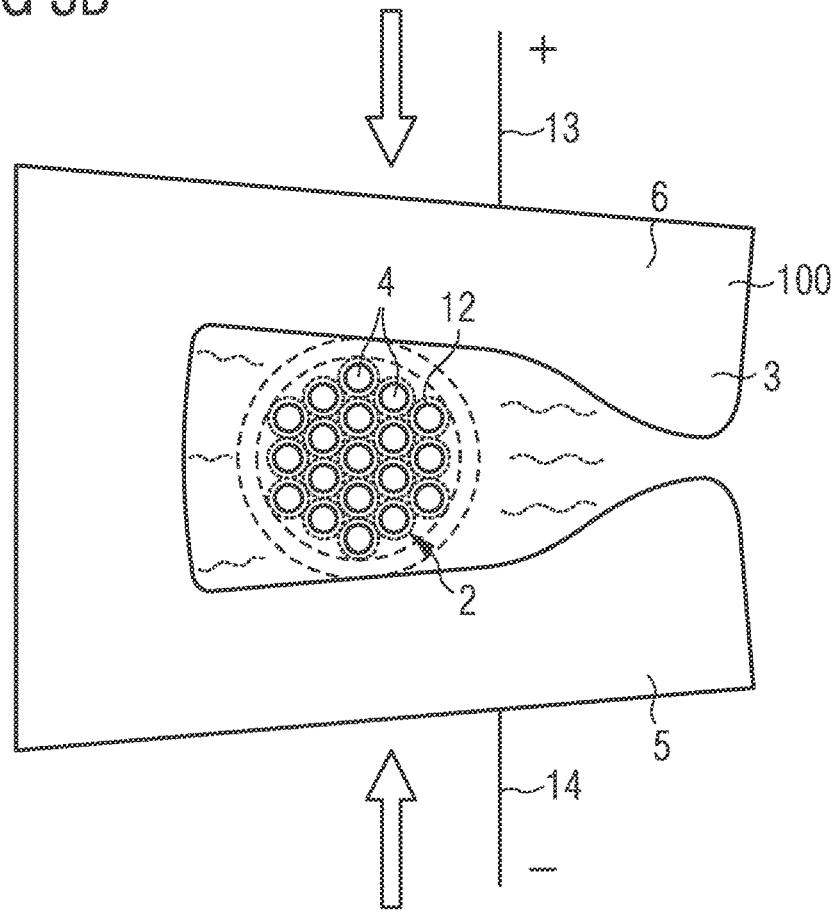
Figure 3C:
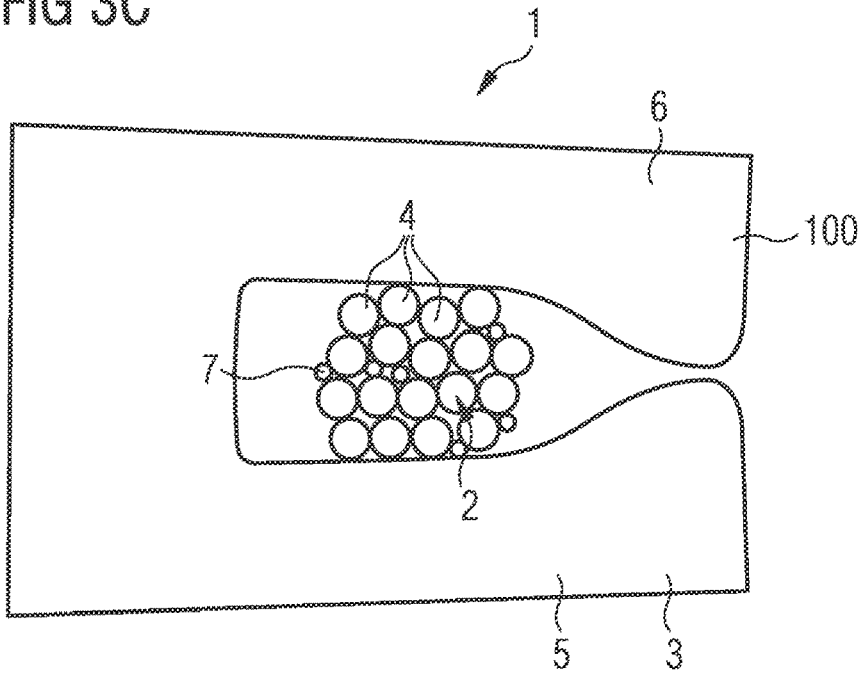
Figure 4A:
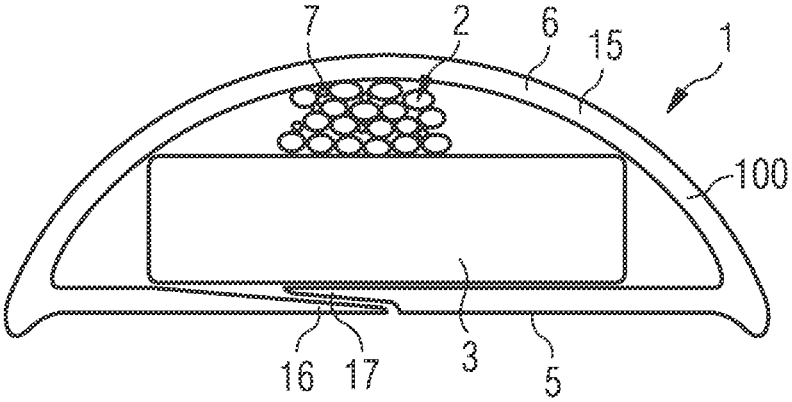
Figure 4B:
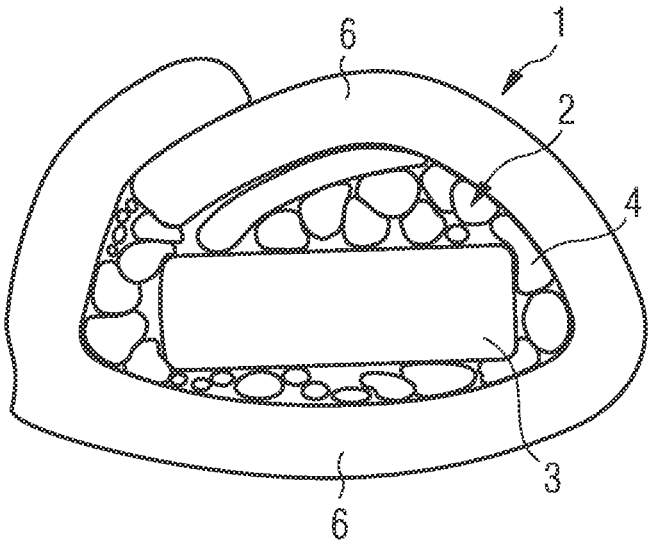
Figure 5:
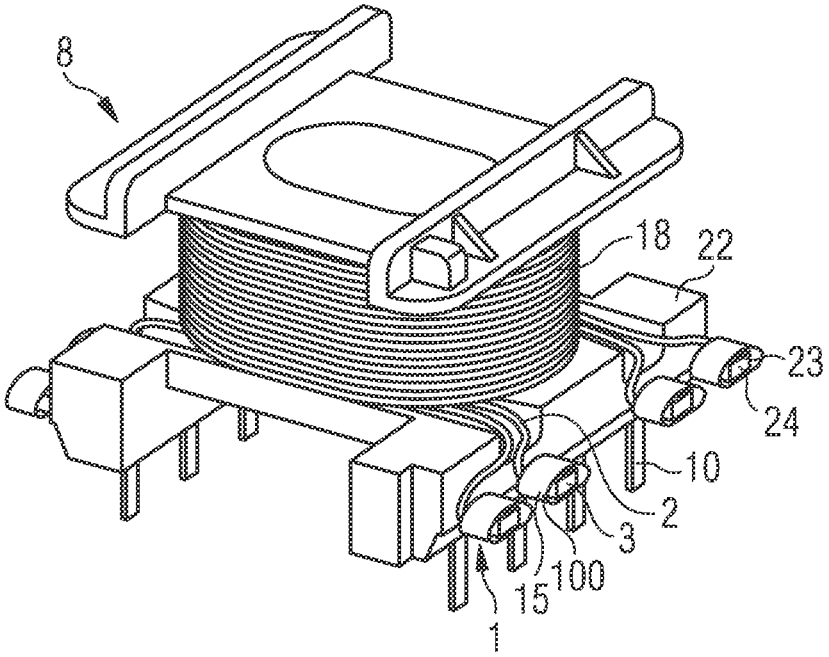
Figure 6A:
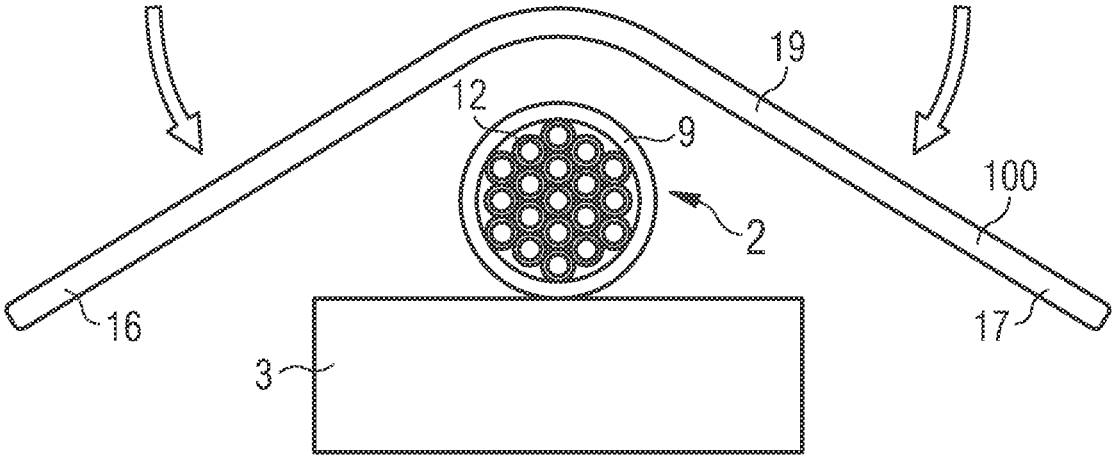
Figure 6B:
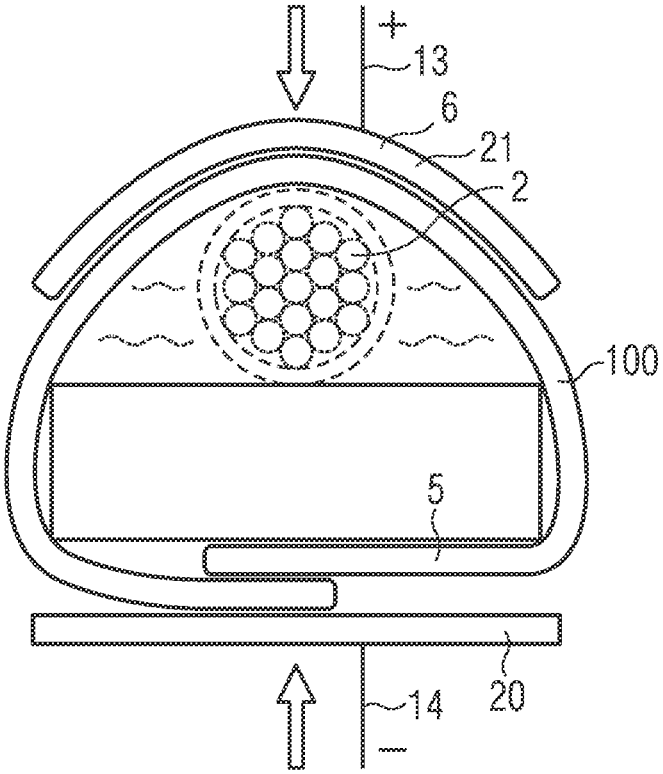
Figure 6C:
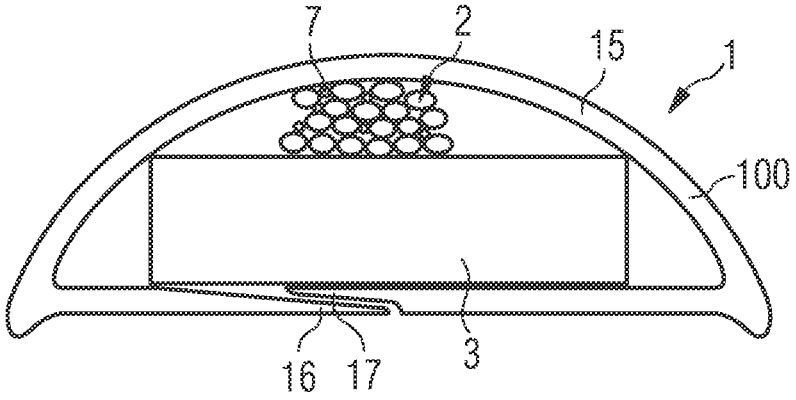
Figure 6D:
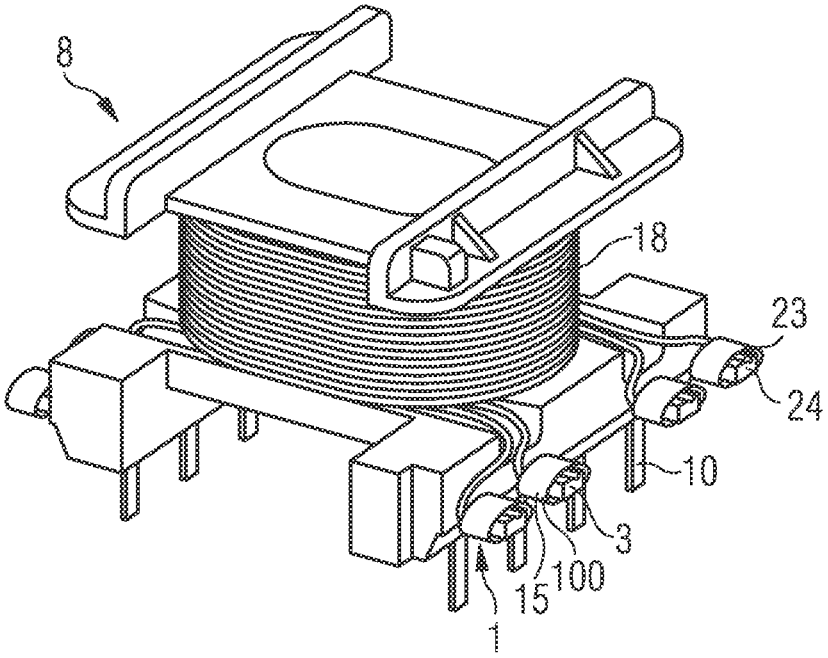
Figure 6E:
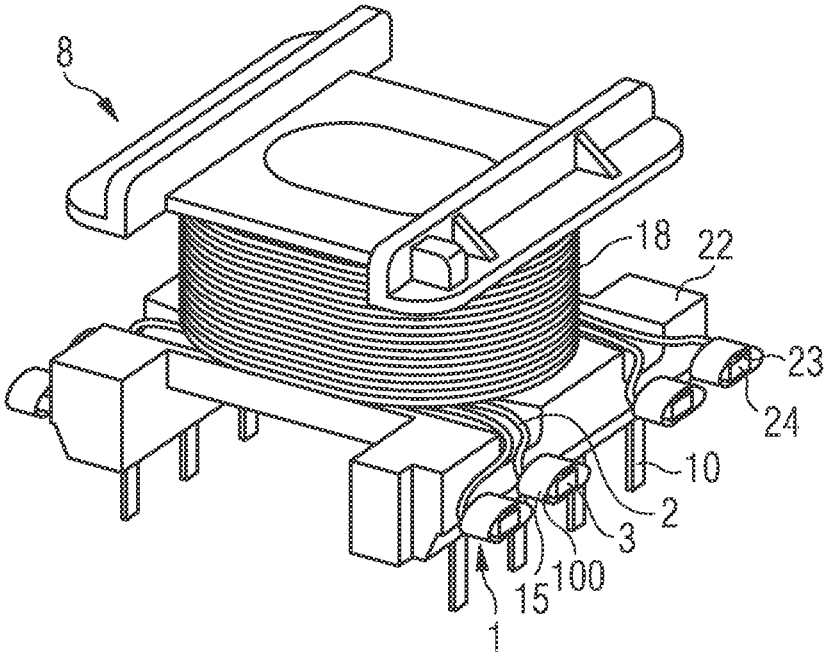
Figure 7:
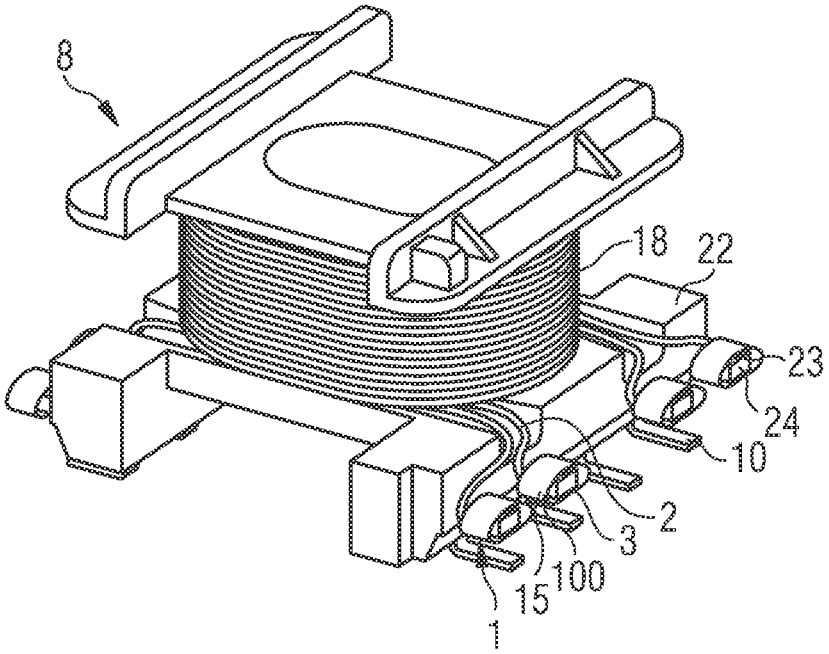
Figure 8:
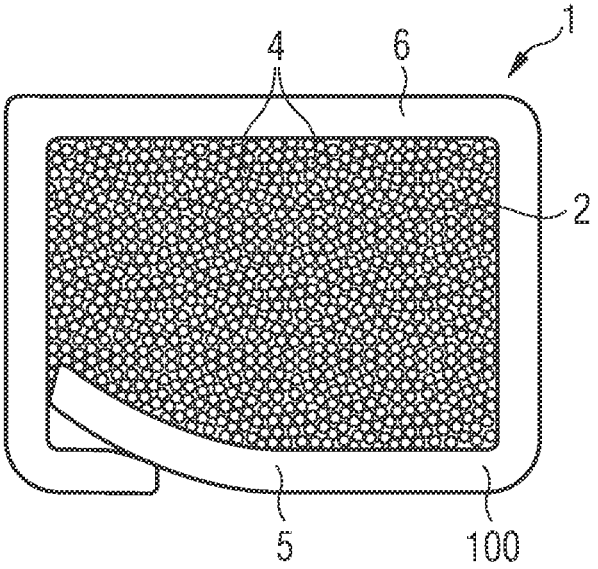
Figure 9:
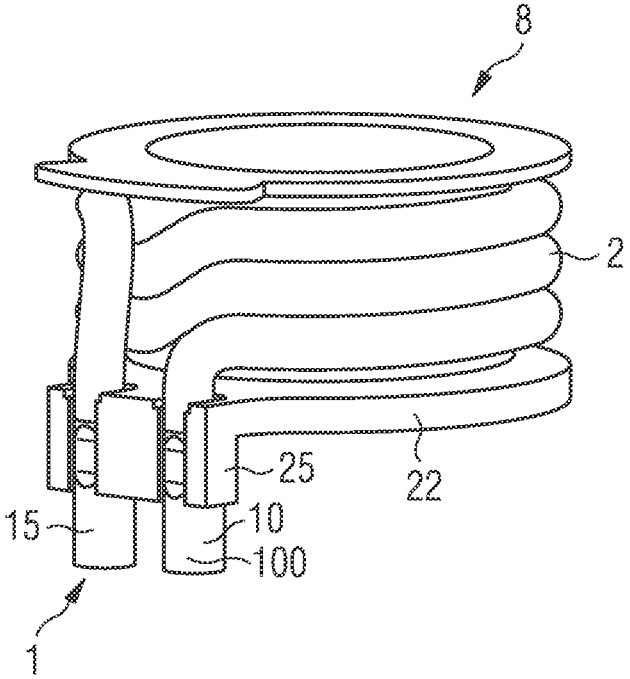

In the figures:

FIG. 1A is a schematic sectional view of one embodiment of a stranded wire contact of a device, FIG. 1B is a sectional view of an embodiment of a stranded wire contact similar to the stranded wire contact of FIG. 1A in an actually produced device, FIG. 2 is a perspective view of the stranded wire contact according to FIGS. 1A and 1B, and a part of a component, FIGS. 3A to 3C show method steps for production of the stranded wire contact of FIGS. 1A, 1B and 2, FIG. 4A is a schematic sectional view of a further embodiment of a stranded wire contact, FIG. 4B is a sectional view of an embodiment of a stranded wire contact similar to the stranded wire contact of FIG. 4A in an actually produced device, FIG. 5 is a perspective view of the stranded wire contact according to FIGS. 4A and 4B, and a component, FIGS. 6A to 6E show method steps for production of the stranded wire contact of FIGS. 4A, 4B and 5, FIG. 7 is a perspective view of a further embodiment of a component with stranded wire contact, FIG. 8 is a sectional view of a further embodiment of a stranded wire contact in a device, FIG. 9 shows an embodiment of a device with the stranded wire contact of FIG. 8.

In the following figures identical reference signs preferably relate to functionally or structurally corresponding parts of the various embodiments.

FIG. 1 is a schematic sectional view of a stranded wire contact 1 comprising a stranded wire 2 and a contact piece 100. The contact piece 100 contacts the stranded wire 2 directly and enables electrical connection of the stranded wire 2. FIG. 1 shows the contact piece 100 in cross-section through the stranded wire 2.

The stranded wire 2 has a multiplicity of individual wires 4. The individual wires 4 are connected electrically and mechanically together and to the contact piece 100. The contact piece 100 and/or the stranded wire 2 are for example part of an electrical device, in particular an inductive device.

The stranded wire 2 in particular forms a winding (see for example winding 18 of FIG. 5) of an electrical device.

FIG. 1 shows an end of the stranded wire 2 which protrudes out of the winding. The individual wires 4 are each surrounded by insulation at least within the winding. Each individual wire 4 has separate insulation. The insulation is in particular enamel insulation. This case relates to enameled stranded wires. The stranded wire 2 in particular is a high-frequency stranded wire.

An outer circumference of the stranded wire 2 may also be surrounded by insulation, e.g. silk braiding, inside the winding. This external sheathing may be, but does not have to be present.

The contact piece 100 has two sub-regions 5, 6, between which the stranded wire 2 is accommodated. During production of the conductor connection 1 the sub-regions 5, 6 are pressed together. The resultant deformation of the contact piece 100 is maintained. The sub-regions 5, 6 are thus permanently plastically deformed. Each of the sub-regions 5, 6 have the shape of a leg, for example. The contact piece 100 may also have a different shape.

The contact piece 100 is configured in particular as a connection piece 3, wherein the connection piece 3 electrically connects the stranded wire 2 to a terminal piece (see terminal piece 10 of FIG. 2) of the device.

The contact piece 100 is connected with the stranded wire 2 by thermal diffusion bonding. To this end, the parts to be connected, i.e. the stranded wire 2 and the contact piece 100, are pressed together and simultaneously heated. The temperature during heating is below the melting temperature of the parts to be connected.

Immediately prior to diffusion bonding the individual wires 4 are still surrounded by insulation. The insulation melts during diffusion bonding, such that an electrical connection of the individual wires 4 may be produced. Where the stranded wire 2 is sheathed, this insulation may also fuse during diffusion bonding, so enabling electrical connection of the stranded wire 2 with the contact piece 3.

Residues of the insulation, e.g. clumped particles 7, present in the stranded wire contact 1 may for example make it apparent that the insulation was initially still present during diffusion bonding. In conventional methods the insulation is removed prior to production of the stranded wire contact 1. This is a complex method step, which is not necessary here. In other conventional methods the insulation is removed by application of a solder material. This leads to the possible presence of balls of solder on the stranded wire contact and to the possibility of damage occurring to the component during soldering due to the high temperature. Damage may occur in particular when a winding of the stranded wire is arranged very close to the stranded wire contact, for example in the region of a few mm therefrom.

FIG. 1B shows a stranded wire contact 1 corresponding to a real embodiment of the stranded wire contact 1 of FIG. 1A. In particular, the multiplicity of individual wires 4 is readily visible.

The individual wires 4 fill the interior of the contact piece 100 virtually completely. The degree of filling may be adjusted by suitable dimensions of the contact piece 100 and suitable exposure to pressure during thermal diffusion bonding.

FIG. 2 is a perspective view of part of a device 8 comprising a stranded wire contact 1 of a stranded wire 2 with a contact piece 100 configured as a connection piece 3. The stranded wire contact 1 is embodied in particular as in FIGS. 1A and 1B. The device 8 for example comprises an inductive device. The device 8 in particular has a winding (not shown) of the stranded wire 2. The winding may be arranged very close to the stranded wire contact 1, in particular in the region of a few mm therefrom, for example at a distance of 1 to 10 mm.

The stranded wire 2 is guided out of the winding and comprises insulation 9 within the winding and also in the region directly adjoining the winding. The insulation 9 is formed for example of an insulating sleeve or another type of sheathing, in which the individual wires 4 are accommodated. The insulation 9 may also be absent. The individual wires 4 may moreover each be surrounded by further insulation, for example an enamel layer.

In the region of the conductor connection 1, the insulation 9 of the stranded wire 2 and the further insulation of the individual wires 4 is not present, such that electrical contact to the connection piece 3 is produced. The insulation 9 has been removed in the region of the conductor connection 1, i.e. in the region in which the stranded wire 2 is arranged within the connection piece 3. In the region in which the stranded wire 2 extends out of the connection piece 3, the insulation 9 is present.

The connection piece 3 takes the form, for example, of a fork, clip, eye or sleeve. As already shown in FIG. 1, the connection piece 3 has two sub-regions 5, 6, which rest against opposing sides of the stranded wire 2. The connection piece 3 may also have other shapes, in particular shapes which make it possible to accommodate the stranded wire 2 between two sub-regions 5, 6 and then to press the sub-regions 5, 6 together against one another, with the stranded wire 2 arranged therebetween.

The connection piece 3 has a conductive material, in particular a metal. The connection piece 3 is arranged for example on one side of the component 8. The connection piece 3 is electrically connected with a terminal piece 10, for example a terminal pin. The terminal pin may be configured in particular for PTH mounting, in which the terminal pin is inserted through a hole in the printed circuit board. Alternatively, the terminal piece 10 may also be configured for SMD mounting. In this case, the terminal piece 10 extends for example in the lateral direction of the device 8. For example, the terminal piece 10 of FIG. 2 is to this end bent outwards or inwards.

In addition, the end of the stranded wire 2 is also mechanically fixed by the connection piece 3.

The connection piece 3 may be configured in one piece with the terminal piece 10. In particular, it may be a metal bracket. One end of the metal bracket may form the connection piece 3 and the other end the terminal piece 10. The middle part of the metal bracket may pass through the support element 22, for example the support material may be injection-molded therearound.

The component 8 has, for example, a multiplicity of stranded wires 2, connection pieces 3 and terminal pieces 10. The connection pieces 3 are, for example, arranged adjacent one another, the terminal pieces 10 being arranged below the connection pieces 3. The connection pieces 3 are for example arranged on a support element 22 of the component 8. The terminal pieces 10 may also be arranged on the support element 22.

FIGS. 3A to 3C show method steps for the production of a conductor connection 1 of a stranded wire 2 with a connection piece 3. The method is suitable for example for producing the conductor connection 1 shown in FIGS. 1 and 2.

FIG. 3A shows a first method step, in which a stranded wire 2 is inserted into a contact piece 100, in particular into a contact piece 100 configured as a connection piece 3. What is illustrated is, for example, an end of a stranded wire 2, wound into a coil. The contact piece 100 takes the form of a fork with two opposing sub-regions 5, 6 and a connection region 11.

The stranded wire 2 has a multiplicity of individual wires 4, for example 4 to 3000 individual wires 4. The stranded wire 2 is surrounded by external insulation 9. The insulation 9 is configured in particular as an insulating sleeve, in which all the individual wires 4 are arranged. The stranded wire 2 may also not have any external insulation 9. Each individual wire 4 is surrounded by internal insulation 12, which for example takes the form of an enamel layer. The individual wires 4 comprise copper, for example. The individual wires 4 for example have thicknesses of between 0.02 and 0.5 mm.

FIG. 3B shows a further method step. The sub-regions 5, 6 are pressed together. A tool, in particular a crimping tool, is used for this purpose, for example. The tool comprises crimping pliers, for example. The pressure exerted from the two sides is indicated by arrows.

During pressing together, the stranded wire 2 is heated. In this case, for example, electrodes 13, 14 are applied to the sub-regions 5, 6, leading to a current flow across the stranded wire 2, in particular across the insulation 9, 12 of the stranded wire 2. The electrodes 13, 14 may be integrated into the tool. As a result of ohmic resistance, the stranded wire 2 heats up, such that the insulation 9, 12 melts. In the process, the insulation 9, 12 evaporates at least in part. Molten residues of the insulation 9, 12 also remain in the stranded wire 2, however.

The exposed individual wires 4 are connected permanently electrically and mechanically together and to the contact piece 100 when pressure is applied and under the elevated temperature. As a result of the exposure to pressure, gaps which arise due to evaporation of the insulation 9, 12 are also at least partly closed. In particular, the individual wires 4 and the contact piece 100 are here connected by diffusion bonding. The method may also be known as hot crimping or diffusion welding.

FIG. 3C shows the stranded wire contact 1 after the connection process. Residues of the insulation 9, 12 are apparent in the form of clumped particles 7. The individual wires 4 are connected firmly together and to the contact piece 100. The described method enables good electrical conductivity to be achieved with a high mechanical connection strength.

In addition, the above-described method enables heating for removal of the insulation 9, 12 to be concentrated onto a small region on the contact piece 100. This is difficult to achieve with conventional soldering methods. Additional insulating bands are optionally used therein, to protect the winding. Such protective devices are not necessary in the present case.

The hot crimping method is a simple, readily controllable process, such that a reliable electrical and mechanical connection can be produced at low cost. For example, no balls of solder arise, the size and extent of which are often difficult to control.

FIG. 4A is a schematic view of a further embodiment of a conductor connection 1 comprising a stranded wire 2 and a contact piece 100 viewed in cross-section through the stranded wire 2.

Unlike in the embodiment of FIG. 1, the contact piece 100 is formed by an enclosure element 15, which is present in addition to a connection piece 3. The enclosure element 15 encloses the stranded wire 2 and the connection piece 3.

In addition, the connection piece 3 is not here embodied in the form of a fork, but rather has a simple rectangular shape in cross-section. The connection piece 3 is of rigid configuration, for example. The connection piece 3 takes the form of a pin, for example. The stranded wire 2 is arranged on the connection piece 3. The stranded wire 2 may also be led around the connection piece 3.

The enclosure element 15 takes the form of a metallic band piece. The enclosure element 15 is bent around a longitudinal axis of the connection piece 3. In this case, marginal zones 16, 17 of the enclosure element 15 may overlap. The enclosure element has two opposing sub-regions 5, 6.

The enclosure element 15, the stranded wire 2 and the connection piece 3 are connected together mechanically and electrically. Residues of insulation 9, 12 in the form of particles 7 or the like, may also be present here. The stranded wire contact 1 may be produced by diffusion bonding.

FIG. 4B shows a stranded wire contact 1 corresponding to a real embodiment of the stranded wire contact 1 of FIG. 4A. In particular, it is apparent here that the stranded wire 2 is wound around the connection piece 3, and that the interior of the enclosure element 15 is filled to a high degree.

FIG. 5 is a perspective view of part of a device 8 comprising a stranded wire contact 1, which is formed of one end of a stranded wire 2, a contact piece 100 and a connection piece 3 according to FIGS. 4A and 4B. The device 8 of FIG. 2 may be similarly configured. The device 8 comprises an inductive device. The device 8 has one or more windings 18 and one or more stranded wires 2.

The ends of the stranded wires 2 are each connected with connection pieces 3. The connection pieces 3 are arranged, for example, in rows on two opposing sides of the device 8.

The connection pieces 3 are connected with a support element 22 of the device 8. The winding 18 is arranged on the support element 22. The support element 22 may also extend partly or completely into the winding 18.

FIGS. 6A to 6E show method steps in the production of a stranded wire contact 1 comprising one end of a stranded wire 2 and a connection piece 3, in which an additional enclosure element 15 is used as contact piece 100. The method is suitable for example for producing the conductor connections 1 shown in FIGS. 4 and 5.

FIG. 6A shows a first method step, in which a stranded wire 2 is arranged on a connection piece 3. What is illustrated is, for example, an end of a stranded wire 2, wound into a coil. The stranded wire 2 is for example placed onto the connection piece 3 or wound around the connection piece 3.

The connection piece 3 has a simple rectangular shape. The connection piece 3 may also have another shape, which is suitable for connection with the stranded wire 2. The stranded wire 2 and/or the connection piece 3 are for example parts of an inductive device 8, in particular the same device 8. The connection piece 3 may be connected with a terminal piece 10 as in FIG. 2. Unlike in FIG. 1, the connection piece 3 does not have to have any opposing sub-regions 5, 6.

The stranded wire 2 is provided with insulation 9 for sheathing purposes and has a multiplicity of individual wires 4, which are each provided with insulation 12. Alternatively, the sheathing insulation 9 may also be absent.

To produce the enclosure element 15, a flat band piece 19 is cut from a metal band, for example. The enclosure element 15 comprises, for example, copper, brass, bronze or other copper alloys as material.

The band piece 19 is bent around the arrangement of stranded wire 2 and connection piece 3. To this end, the arrangement is inserted, for example, into a crimping device, and the band piece 19 is introduced and laid around the arrangement through the exertion of force (see arrows). In the process, marginal zones 16, 17 of the band piece 19 are laid on top of one another.

Such an enclosure element 15 is conventionally known as a "splice crimp". The enclosure element 15 differs from a prefabricated sleeve, into which one or more conductors are inserted. The present enclosure element 15 acquires its sleeve shape only during arrangement thereof around stranded wire 2 and connection piece 3. The stranded wire 2 and the connection piece 3 are thus not inserted into the enclosure element 15. The enclosure element 15 is not formed in one piece either with the stranded wire 2 or with the connection piece 3.

FIG. 6B shows a further method step, similar to the method step according to FIG. 3B. The contact piece 100 configured as an enclosure element 15 has two sub-regions 5, 6, between which the stranded wire 2 has been arranged. In the method, force is exerted from two opposing sides onto the arrangement of enclosure element 15, connection piece 3 and stranded wire 2.

To this end, for example, a tool with two stamps 20, 21 is used. A first stamp 20 is for example of flat configuration and is pressed from below against the enclosure element 15. A second stamp 21 is curved in shape, for example, and is pressed from above onto the enclosure element 15. The first stamp 20 may also merely apply a counterforce to the force exerted by the second stamp 21.

The curved shape of the second stamp 21 serves in particular to limit the width of the conductor connection 1. This is advantageous, for example, when a plurality of conductor connections 1 are arranged adjacent one another.

During pressing together, the stranded wire 2 is heated. In this case, electrodes 13, 14 are for example applied to the stamp 20, 21. The electrodes 13, 14 may be integrated into the tool. The contact piece 100, in particular the opposing sub-regions 5, 6, are brought into contact with the electrodes 13, 14. The stranded wire 2 is heated by the current flow, such that the insulation 9, 12 melts.

Under the applied pressure and the elevated temperature, the exposed individual wires 4 are permanently connected electrically and mechanically together, to the connection piece 3 and to the enclosure element 15 by diffusion bonding. The connection piece 3 is likewise connected to the enclosure element 15.

FIG. 6C shows the resultant stranded wire contact 1. Owing to the shape of the stamps 20, 21, the stranded wire contact 1 has a curved shape on one side and a flat shape on the opposite side. As a result of the method used, particles 7 of the insulation 9, 12 are present.

The stranded wire contact 1 may be completely or almost completely filled within the enclosure element 15 with the material of the stranded wire 2 and of the connection piece 3. The interspaces apparent in the figure are filled, for example in the case of a stranded wire 2 wound around the connection piece 3, with the stranded wire 2, as in FIG. 1B.

Taking the device 8 of FIG. 5 as an example, FIG. 6D shows the stranded wire contact 1 after the method step of diffusion bonding.

The free ends 23, 24 of the connection piece 3 and of the stranded wire 2 project from the enclosure element 15. The free ends 23, 24 may yet be cut off in a subsequent step.

FIG. 6E shows the stranded wire contact 1 with cut-off ends. The stranded wire 2, the connection piece 3 and the enclosure element 15 are thus configured to be flush at the ends. The device 8 may for example then be mounted with its terminal pieces 10 on a printed circuit board.

FIG. 7 is a perspective view of a further embodiment of a component 8 comprising a stranded wire contact 1. In contrast to FIG. 5, the component 8 is configured for SMD mounting. For mounting purposes, the component 8 may be placed onto a printed circuit board and the terminal pieces 10 may be soldered to the printed circuit board.

The terminal pieces 10 extend in the lateral direction of the component 8. In particular, the terminal pieces 10 extend horizontally relative to a mounting surface of the component 8. The terminal pieces 10 in the present case extend parallel to the connection pieces 3. The terminal pieces 10 are directed outwards, like the connection pieces 3. The terminal pieces 10 may alternatively also be directed inwards.

When producing the component 8, first of all, for example, the component 8 is produced according to FIG. 5 and then the terminal pieces 10 are bent back.

The embodiment of the component 8 of FIG. 2 may accordingly also be configured for SMD mounting.

FIG. 8 shows a further embodiment of a stranded wire contact 1 comprising one end of a stranded wire 2 and a contact piece 100. The contact piece 100 is formed by an enclosure element 15, which is configured as described in relation to FIGS. 4A and 4B. The stranded wire 2 may also be configured in accordance with FIGS. 4A and 4B.

In contrast to the stranded wire contact 1 of FIGS. 4A and 4B, no connection piece 3 is present, such that the enclosure element 15 merely surrounds the stranded wire 2. The stranded wire contact 1 is otherwise produced in accordance with FIGS. 6A to 6D. In particular, the contact piece 100 is connected to the stranded wire 2 by thermal diffusion bonding.

In this embodiment, the terminal piece 10 for connection to a printed circuit board may be formed directly by the stranded wire contact 1.

FIG. 9 shows an embodiment of a device 8 with a stranded wire contact 1 according to FIG. 8. The device 8 has two stranded wire contacts 1. The stranded wire contacts 1 form the terminal pieces 10 for connection with a printed circuit board.

The stranded wire contacts 1 are oriented vertically relative to a mounting plane of the device 8. The device 8 is configured in particular for PTH mounting, wherein the stranded wire contacts 1 are passed through the printed circuit board. An embodiment for SMD mounting is also conceivable.

The free ends of the stranded wire 2, in particular the stranded wire contacts 1, are accommodated for mechanical fixation in a holder 25. The stranded wire 2 is thus fixed relative to the support element 22 of the device 8. The holder 25 is electrically insulating and may be configured as a constituent of the support element 22.

LIST OF REFERENCE SIGNS

1 Stranded wire contact
2 Stranded wire
3 Connection piece
4 Individual wire
5 Sub-region
6 Sub-region
7 Particles
8 Device
9 Insulation
10 Terminal piece
11 Connection region
12 Insulation
13 Electrode
14 Electrode
15 Enclosure element
16 Marginal zone
17 Marginal zone
18 Winding
19 Band piece
20 Stamp
21 Stamp
22 Support element
23 Free end
24 Free end
25 Holder
100 Contact piece

The invention claimed is:

1. Electrical device, comprising a winding of a stranded wire, wherein the stranded wire has a multiplicity of individual wires, wherein each of the individual wires within the winding is surrounded by separate insulation, and further comprising a stranded wire contact, the stranded wire contact including a portion of the stranded wire and having a contact piece that at least in part surrounds the portion of the stranded wire, and wherein the contact piece is connected to the stranded wire by thermal diffusion bonding.

2. Electrical device according to claim 1, having a terminal piece for electrical connection of the device, wherein the terminal piece is electrically connected with the stranded wire contact.

3. Electrical device according to claim 1, in which the contact piece and the terminal piece are configured as different ends of an integral element.

4. Electrical device according to claim 1, in which the stranded wire and the contact piece each have a free end, wherein the free ends are arranged flush.

5. Electrical device according to claim 1, in which the contact piece has two sub-regions between which the stranded wire is arranged.

6. Electrical device according to claim 5, in which the sub-regions take the form of legs.

7. Electrical device according to claim 1,
in which the contact piece is formed of a metallic band piece.

8. Electrical device according to claim 7, in which the metallic band piece is crimped around the stranded wire.

9. Electrical device according to claim 7, wherein the contact piece corresponds to the bent metallic band piece.

10. Electrical device according to claim 7, wherein lateral regions of the metallic band piece overlap.

11. Electrical device according to claim 2, wherein the terminal piece is electrically connected with a connection piece, wherein the contact piece surrounds the stranded wire and the connection piece.

12. Electrical device according to claim 1, wherein the contact piece encloses the stranded wire and a connection piece, and wherein the connection piece is arranged on a support element of the device.

13. Electrical device according to claim 12,
wherein the connection piece takes the form of a contact pin.

14. Electrical device according to claim 1, wherein the stranded wire contact is configured directly for connection to a printed circuit board.

15. Electrical device with a stranded wire contact, comprising a portion of a stranded wire with a multiplicity of individual wires and a connection piece, wherein the connection piece is fastened to a support element of the device, wherein the stranded wire contact is solder-free and wherein the stranded wire is connected to the connection piece by thermal diffusion bonding.

16. Electrical device according to claim 15, wherein the stranded wire forms a winding, which is arranged on a support element of the device.

17. Method for producing the stranded wire contact of an electrical device, comprising the steps of:
A) providing a stranded wire having a multiplicity of individual wires,
B) forming an arrangement of the stranded wire with a contact piece,
C) connecting the stranded wire to the contact piece by thermal diffusion bonding.

18. Method according to claim 17,
in which after step C) the end of the stranded wire is detached.

19. Method according to claim 17,
in which the contact piece has two sub-regions between which the stranded wire is arranged in step B) and wherein in step C) the sub-regions are pressed against the stranded wire.

20. Method according to claim 17,
in which prior to step B) the stranded wire is arranged on a connection piece and in step B) the contact piece is arranged around the stranded wire and the connection piece.

* * * * *